US009125511B2

(12) United States Patent
Kao et al.

(10) Patent No.: US 9,125,511 B2
(45) Date of Patent: Sep. 8, 2015

(54) INSTALLATION UNIT OF WINDOW CURTAIN ASSEMBLY

(71) Applicant: UNI-SOLEIL ENT. CO., LTD., Tainan (TW)

(72) Inventors: Yu-Ting Kao, Tainan (TW); Joe Dewayne Wicker, Memphis, TN (US); David A. Wicker, Memphis, TN (US)

(73) Assignees: Uni-Soleil Ent. Co., Ltd., Tainan (TW); Joe Dewayne Wicker, Memphis, TN (US); David A. Wicker, Memphis, TN (US)

( * ) Notice: Subject to any disclaimer, the term of this patent is extended or adjusted under 35 U.S.C. 154(b) by 141 days.

(21) Appl. No.: 14/075,051

(22) Filed: Nov. 8, 2013

(65) Prior Publication Data

US 2015/0129141 A1 May 14, 2015

(51) Int. Cl.

| | |
|---|---|
| ***A47H 15/00*** | (2006.01) |
| ***A47H 15/02*** | (2006.01) |
| ***A47H 5/03*** | (2006.01) |

(52) U.S. Cl.

CPC ..... *A47H 15/02* (2013.01); *A47H 5/03* (2013.01); *A47H 2015/005* (2013.01)

(58) Field of Classification Search

USPC ..... 160/330, 340, 341, 344, 345; 16/87.2, 16/87.4 R, 87 R; 206/326

IPC ..... A47H 2015/005

See application file for complete search history.

(56) References Cited

U.S. PATENT DOCUMENTS

| | | | | | |
|---|---|---|---|---|---|
| 1,295,141 | A * | 2/1919 | Elliott | 206/346 |
| 2,317,531 | A * | 4/1943 | Hudson et al. | 206/326 |
| 2,966,695 | A * | 1/1961 | Dwyer | 16/93 D |
| 3,450,255 | A * | 6/1969 | Mosetich | 206/347 |
| 3,587,131 | A * | 6/1971 | Graf | 16/95 R |
| 3,885,669 | A * | 5/1975 | Potucek | 206/338 |
| 3,958,691 | A * | 5/1976 | Schaeffer | 206/326 |
| 4,282,630 | A * | 8/1981 | Toder | 16/93 D |
| 7,788,769 | B2 * | 9/2010 | Wicker et al. | 16/87 R |

FOREIGN PATENT DOCUMENTS

| | | |
|---|---|---|
| TW | M251550 | 1/1993 |
| TW | M330059 | 10/1996 |
| TW | M387615 U1 | 9/2010 |

* cited by examiner

*Primary Examiner* — David Purol

(74) *Attorney, Agent, or Firm* — Rosenberg, Klein & Lee

(57) ABSTRACT

An installation unit for installation to a rail of a window curtain assembly includes an elongate rack and multiple slots are defined through the rack. Multiple sliding members are connected to the rack. The sliding members are installed to the rail of the window curtain assembly. By removing the rack from the sliding members, the sliding members are remained in the rail of the window curtain assembly. The installation of the sliding members to the rail is easy and quick.

12 Claims, 13 Drawing Sheets

INSTALLATION UNIT OF WINDOW CURTAIN ASSEMBLY

BACKGROUND OF THE INVENTION

1. Fields of the invention

The present invention relates to an installation unit of a window curtain assembly, and more particularly, to an installation unit comprised of a rack and sliding members and being easily assembled to the window curtain assembly.

2. Descriptions of Related Art

The window curtains are used widely in modern life so as to allow outside light to enter into the room, or to restrict outside light from entering into the room as well as keep control the room temperature. The use of window curtains increase the value of the decoration and improves the quality of life. In order to make the patterns or colors of the window curtains to be updated, the replacement of the window curtains are a necessary step to achieve this purpose.

Taiwan Publish Nos. M251550 , M387615 and M330059 disclose multiple sliding members in a rail of the window curtain assembly, and each sliding member is connected with multiple slats.

The sliding members are connected to a cord so that the sliding members are moved by the action of the cord. Each of the sliding members has rollers which move along the rail, and each of the sliding members is connected with a hanging member which is connected to the curtain with a male snap sewn on the top of the curtain. When assembling the sliding members to the rail, the cord is cut according to the length of the rail so that the desired number of the sliding members is connected to the cord. The sliding members are then connected to the rail one by one, and curtain snaps are connected to the hanging members one by one. By moving the sliding members, the rollers move along the rail and the curtain snaps are expanded or collected to adjust the amount of outdoor light entering into the room.

However, when assembling the sliding members to the rail, the number of the sliding members is decided according to the length of the rail, and the cord is cut according to the length of the rail. The sliding members are then connected to the rail one by one. It is noted that the assembling takes a lot of time. If one of the sliding members is installed in the reverse direction, then the sliding member has to be removed from the rail, and re-connected to the rail. This reduces the efficiency of assembling. Besides, these sliding members are connected to the cord at even distance, so that the combination of the sliding members and the cord is arranged in a roll for the convenience of transportation. The cords and sliding members are easily tangled with each other, so that this is inconvenient for the users to install them to the rails.

The present invention intends to provide an installation unit of a window curtain assembly, and the installation unit comprises a rack and sliding members and improves the shortcomings mentioned above.

SUMMARY OF THE INVENTION

The present invention relates to a rack for cooperation with sliding members of a window curtain assembly, and the rack is an elongate plate having multiple slots defined therethrough. The sliding members are connected to the slots.

Preferably, each of the slots has a top inside and a bottom inside, wherein each top inside has multiple positioning members extending therefrom.

Preferably, the slots are separated by even intervals.

Preferably, the slots are separated by connecting sections and each connecting section is connected between the top and bottom insides of the adjacent slots.

Preferably, the rack has multiple notches defined in one of two sides thereof and the notches are located alternatively to the slots.

Preferably, the elongate plate has anti-slip protrusions formed on at least one surface thereof.

Preferably, the elongate plate has a pulling section extending from one of two ends thereof.

The present invention further provides an installation unit of a window curtain assembly, and the unit comprises an elongate rack having multiple slots defined therethrough, and multiple sliding members connected to the slots. Each sliding member has a connection portion for being connected to the curtain. A roller is connected to each sliding member and movable along the rail of the window curtain assembly. Multiple engaging portions extend horizontally along the axis of the roller from one of two sides of each of the sliding members. A boss extends from each of the engaging portions which is engaged with the slots of the rack. The bosses are stopped by the outside of the slots.

Furthermore, the present invention also provides an installation unit of a window curtain assembly, and comprises an elongate rack and multiple slots are defined therethrough so that the sliding members are connected to the slots. Each of the slots has a top inside and a bottom inside, wherein each top inside has multiple positioning members extending therefrom. The sliding members each have a connecting portion which is connected to the curtain. A roller is connected to each sliding member and is movable along the rail of the window curtain assembly. Multiple engaging portions extend horizontally along the axis of the roller from one of two sides of each of the sliding members. Each engaging portion has a positioning recess defined therein. The engaging portions are engaged with the slots of the rack and the positioning members are engaged with the positioning recesses.

Preferably, the slots are separated by connecting sections and each connecting section is connected between the top and bottom insides of adjacent slots.

Preferably, the rack has multiple notches defined in one of two sides thereof and the notches are located alternatively to the slots.

Preferably, the elongated plate has anti-slip protrusions formed on at least one surface thereof.

Preferably, the elongate plate has a pulling section extending from one of two ends thereof.

Preferably, the each sliding member is connected with a cord and the sliding members are evenly separated to each other on the cord.

The primary object of the present invention is to provide an installation unit for installation to a rail of a window curtain assembly, and the installation unit includes an elongated rack and the sliding members which are connected to the slots in the rack so that the number of the sliding members is organized on the rack.

Another object of the present invention is to provide an installation unit for installation to a rail of a window curtain assembly, wherein the sliding members are connected to the rack. The rack and the sliding members are installed to the rail of the window curtain assembly easily and quickly. By removing the rack from the sliding members, the sliding members remain in the rail of the window curtain assembly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
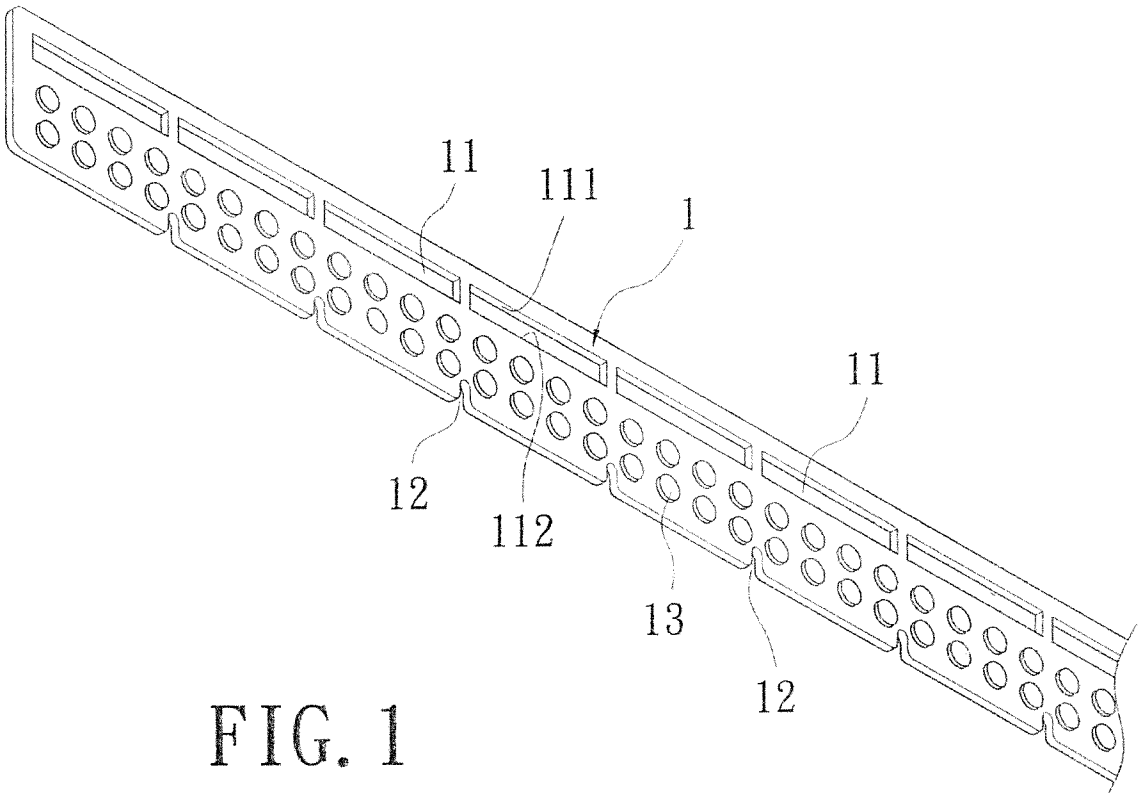
FIG. 1 is a perspective view to show the rack of the present invention.

Referring to FIGS. 1 to 4, the installation unit of a window curtain assembly comprises a rack 1 which is an elongate plate having multiple slots 11 defined therethrough. Multiple sliding members 2 are connected to the slots 11. The rack 1 has multiple notches 12 defined in one of two sides thereof and the notches 12 are located alternatively to the slots 11. The rack 1 has anti-slip protrusions 13 formed on at least one surface thereof. Each of the slots 11 has a top inside Ill and a bottom inside 112. The slots 11 are separated by connection sections 14 and each connection section 14 is connected between the top and bottom insides 111, 112 of adjacent slots 11.

Figure 2:
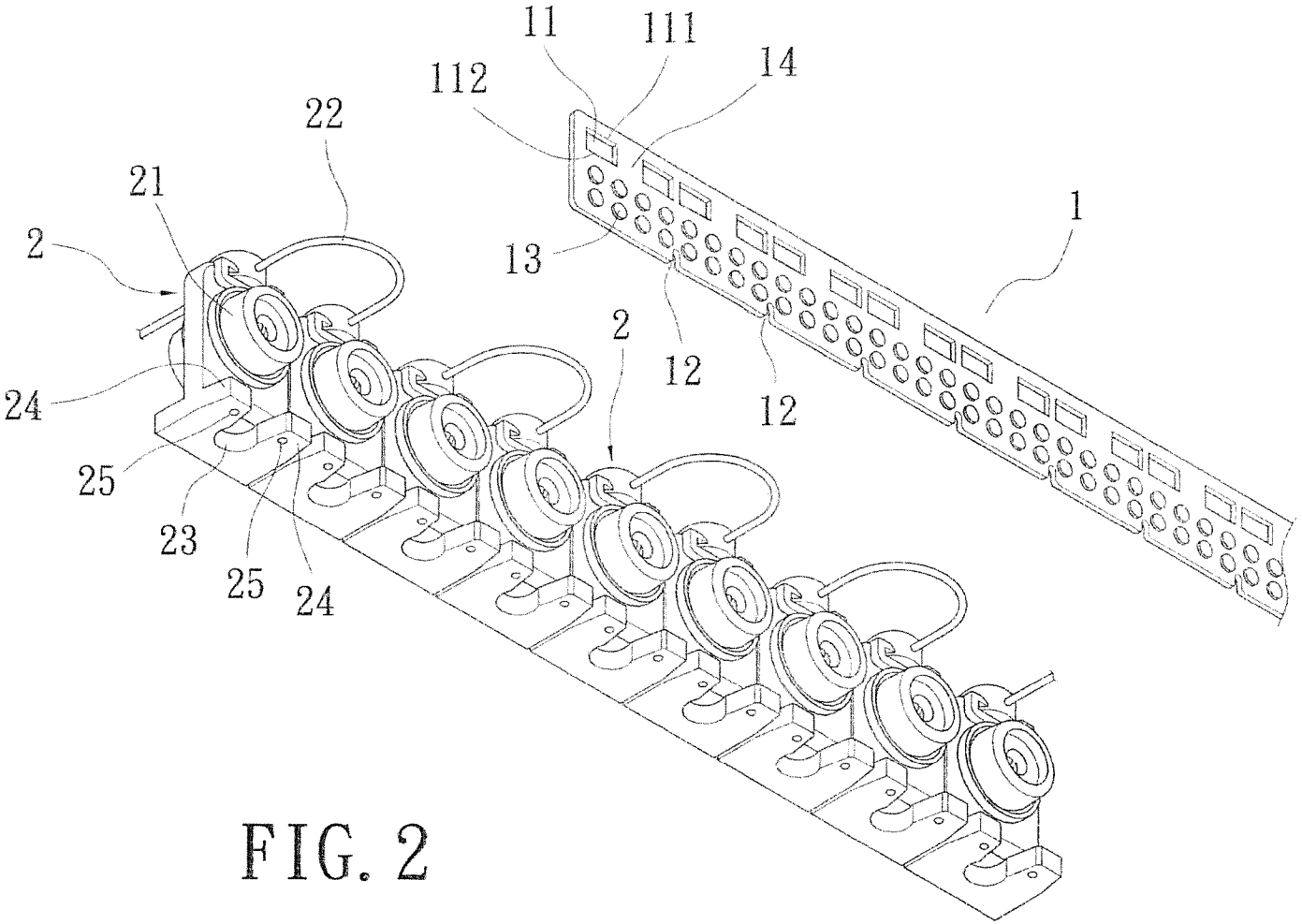
FIG. 2 is an exploded view to show the rack and the sliding members of the present invention.
Figure 3:
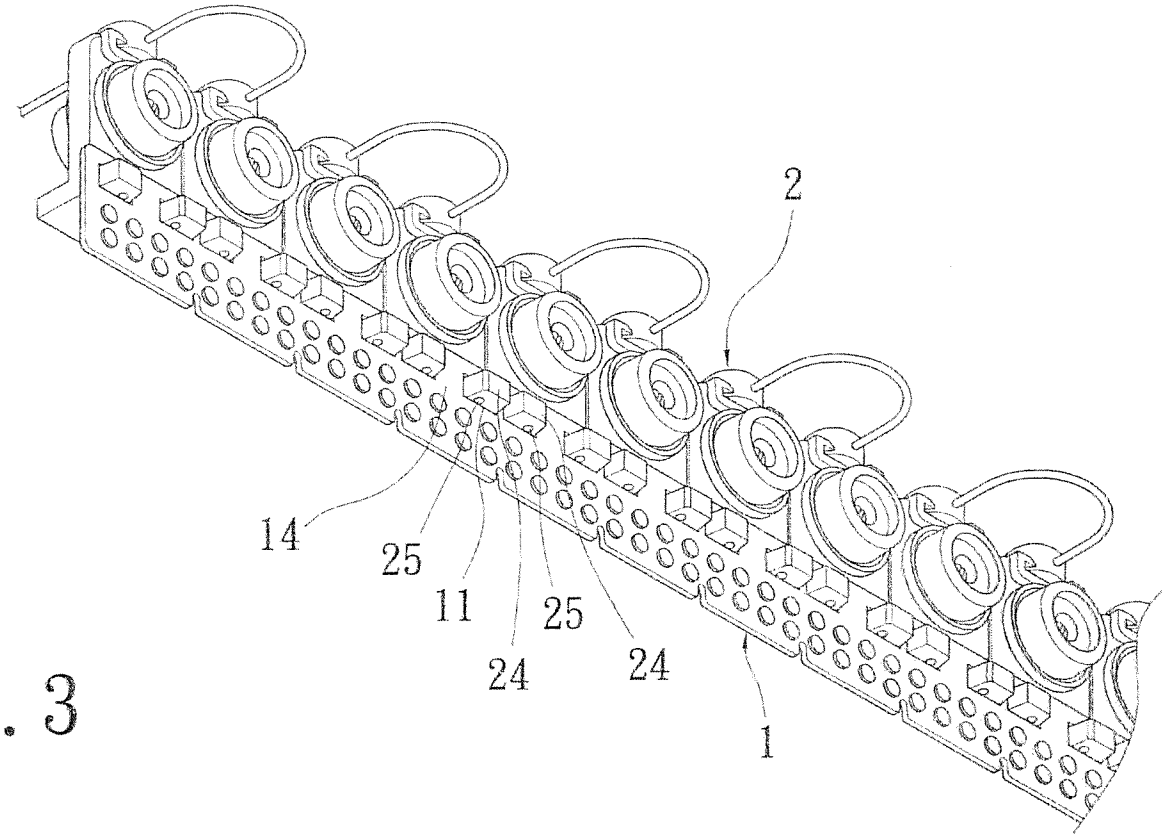
FIG. 3 is a perspective view to show the combination of the rack and the sliding members of the present invention.
Figure 4:
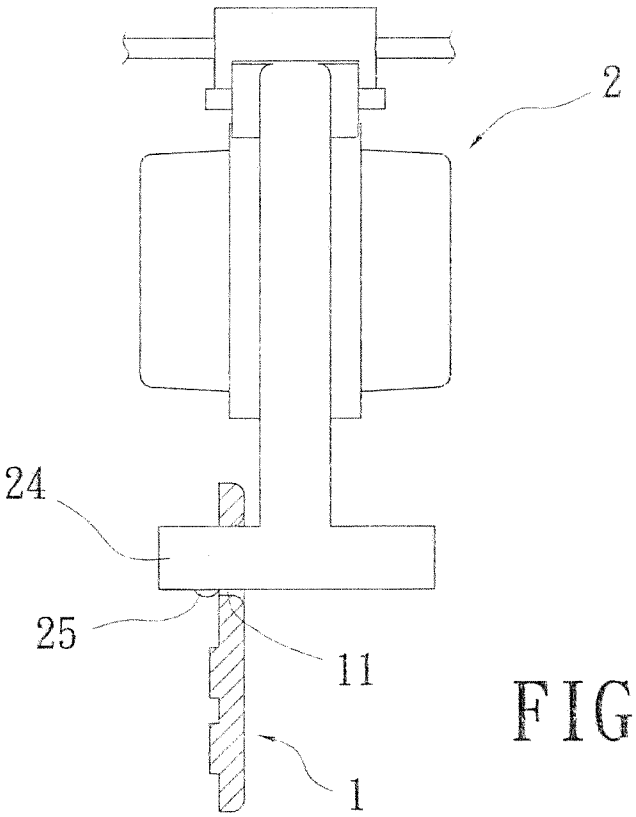
FIG. 4 is an end cross sectional view of the combination of the rack and the sliding members of the present invention.
Figure 5:
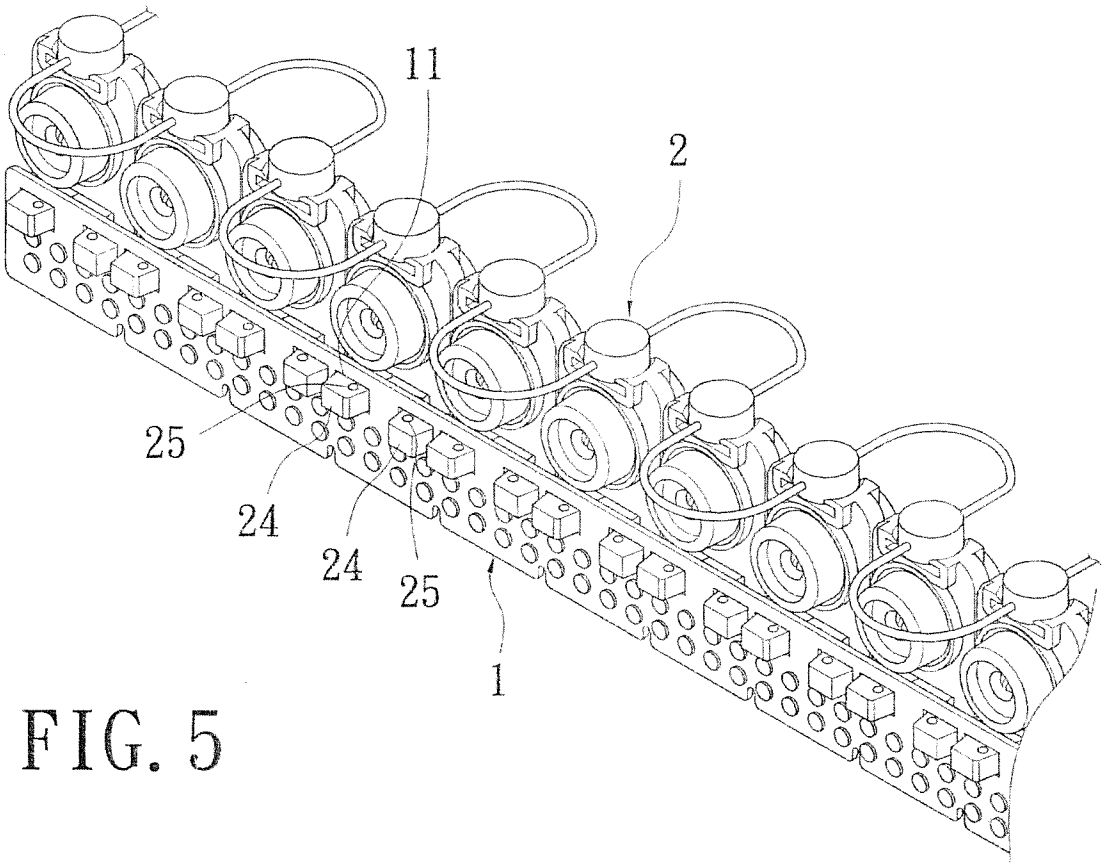
FIG. 5 is a perspective view to show the second embodiment of the combination of the rack and the sliding members of the present invention.

The sliding members 2 each have a roller 21 connected thereto so as to move along the rail (not shown) of the window curtain. A cord 22 is connected to the respective top ends of the sliding members 2. Each sliding member 2 has a connection portion 23 located at the lower end thereof so as to be connected with hanging members (not shown) to which the curtain (not shown) is connected. Multiple engaging portions 24 extend horizontally along the axis of the roller 21 from one of two sides of each of the sliding members 2. A boss 25 extends from the top face or the bottom face of each of the engaging portions 24. In FIGS. 2 to 4, the bosses 25 are formed on the bottom faces of the engaging portions 24. In FIG. 5, the bosses 25 are formed on the top faces of the engaging portions 24. The engaging portions 24 extend outward from the connection portions 23 of the sliding members 2.

As shown in FIGS. 3 to 5, when installing the sliding members 2 to the rack 1, the engaging portions 24 of the sliding member 2 extend through the slots 11 of the rack 1, and the bosses 25 on the top face or the bottom face of the engaging portions 24 are stopped by the top inside 111 or the bottom inside 112 of the slot 11. Therefore, the sliding member 2 is connected to the rack 1. The rest of the sliding members 2 can be connected to the rack 1 by repeating the same steps mentioned above.

By counting the number of the notches 12 of the rack 1, the number of the sliding members 2 is easily counted, and the rack 1 is cut according to the length of the rail of the window curtain assembly. The rack 1 and the sliding members 2 are then installed to the rail and the rollers 21 are in contact with the rail of the window curtain assembly. The assembler then pulls the rack 1 outside of the rail, because there are only bosses 25 located between the sliding members 2 and the rack 1, so that the rack 1 is easily removed from the sliding members 2. Therefore, only the sliding members 2 remain on the rail, in other words, the installation of the sliding members 2 to the rail is easy and quick. When pulling the rack 1, the anti-slip protrusions 13 increase the friction between the rack 1 and the fingers so as to allow the assembler to easily pull the rack 1.

Figure 6:
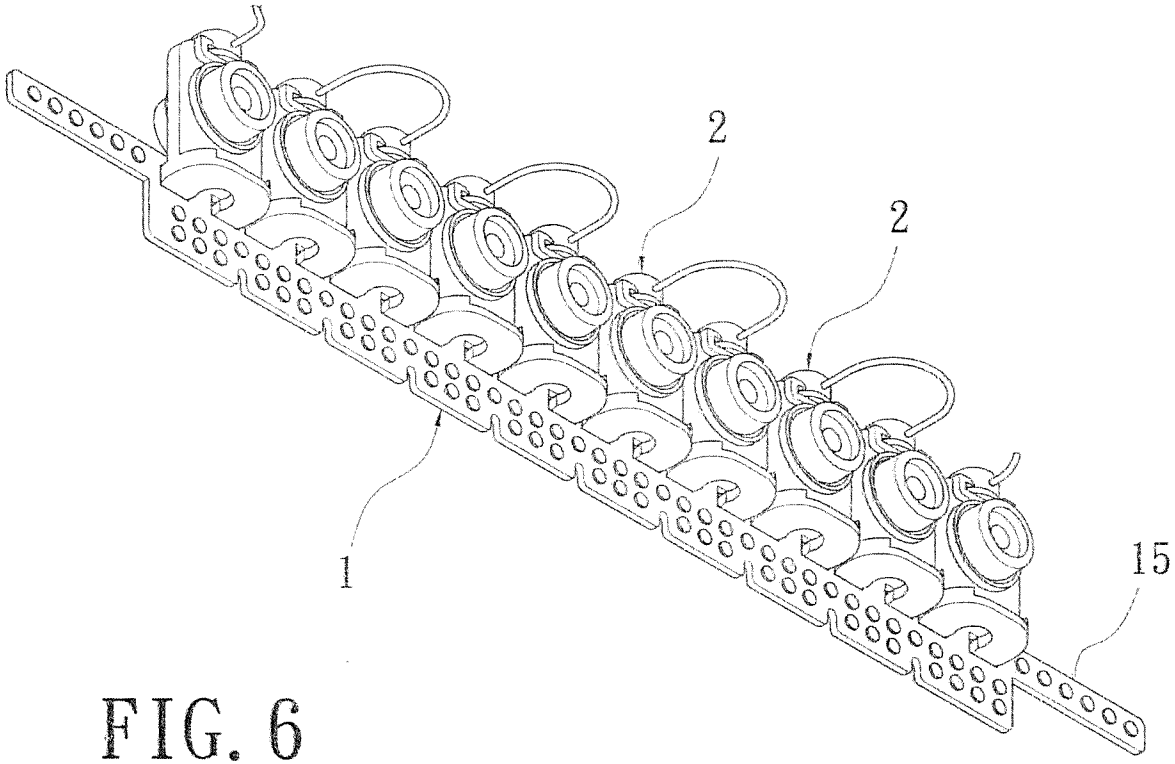
FIG. 6 is a perspective view to show the third embodiment of the combination of the rack and the sliding members of the present invention.

As shown in FIG. 6, in this embodiment, the rack 1 has a pulling section 15 extending from one of two ends thereof. The pulling section 15 allows the assembler to easily engage the rack 1 with the sliding members 2 with the rail, and also to easily pull the rack 1 from the sliding member 2 by holding the pulling section 15.

Figure 7:
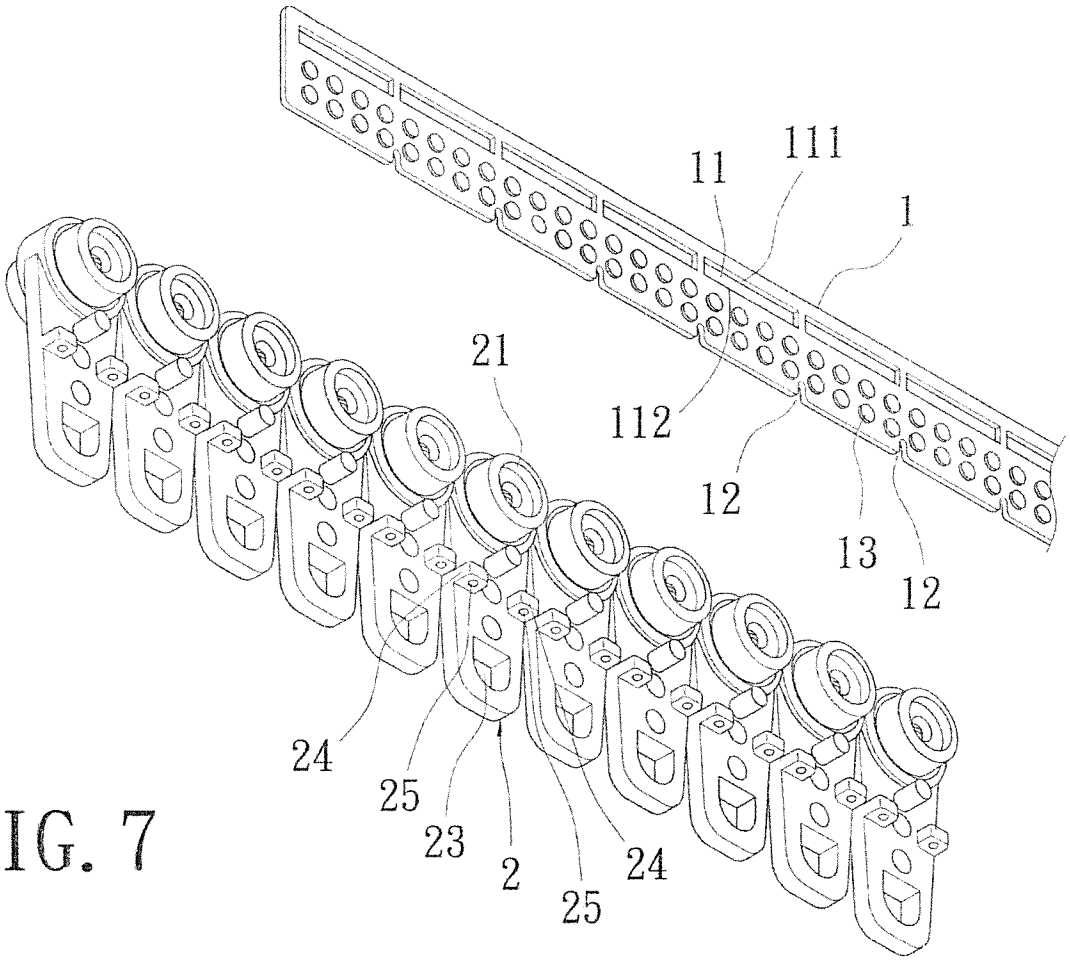
FIG. 7 is an exploded view to show the fourth embodiment of the rack and the sliding members of the present invention.

As shown in FIG. 7, this embodiment is similar to the embodiment in FIG. 1, and the sliding members 2 are cooperated with other hanging members. The engaging portion 24 of each sliding member 2 directly extends to a position between the roller 21 and the connection portion 23. This embodiment cam also allows the engaging portions 24 to be engaged with the slot 11 of the rack 1, and the bosses 25 on the top surface or bottom surface thereof are engaged with the top inside 111 or the bottom inside 112 of the slot 11. In FIG. 7, the bosses 25 are located on the bottom surface to connect the sliding members 2 with the rack 1.

Figure 8:
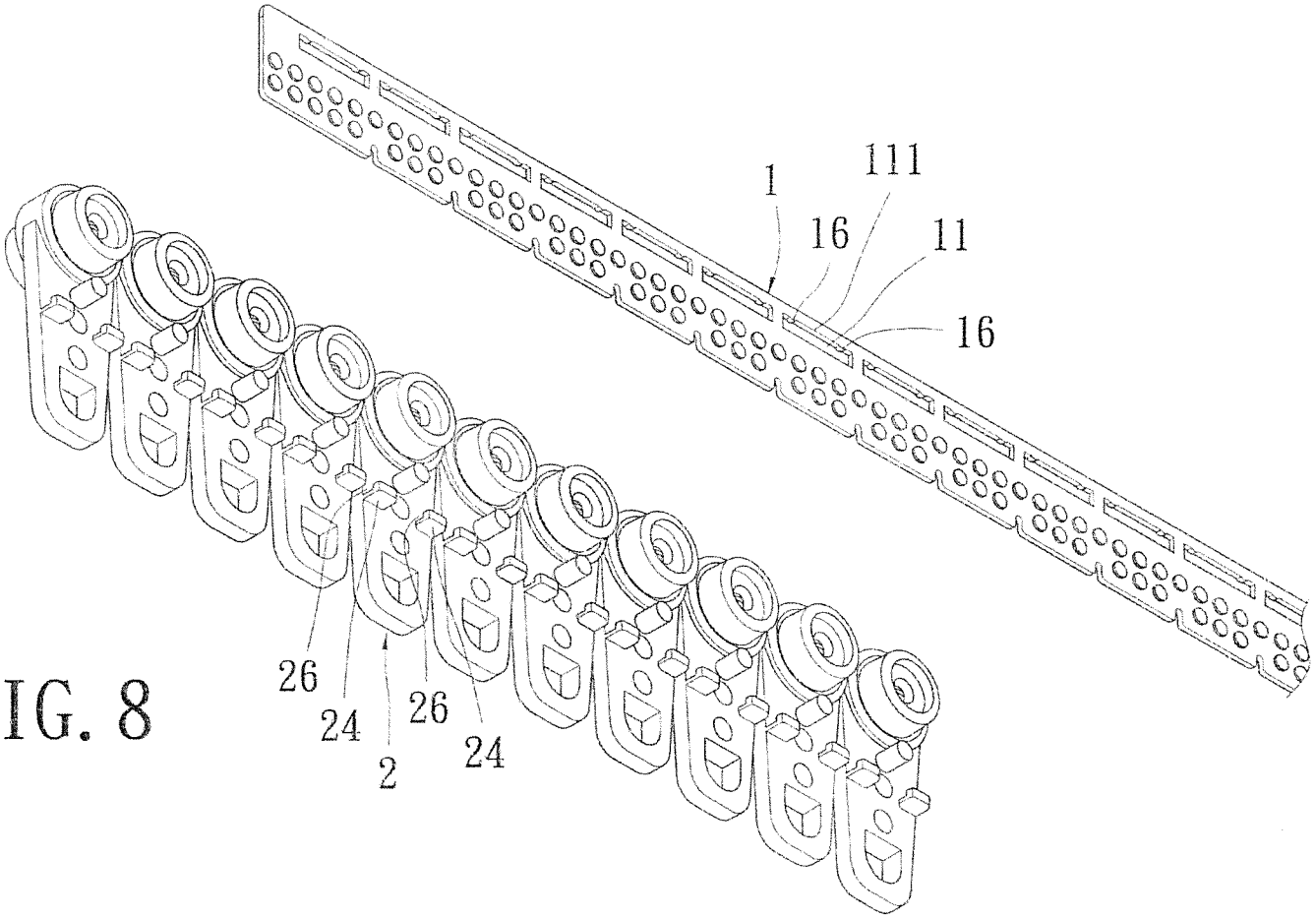
FIG. 8 is an exploded view to show the fifth embodiment of the rack and the sliding members of the present invention.
Figure 9:
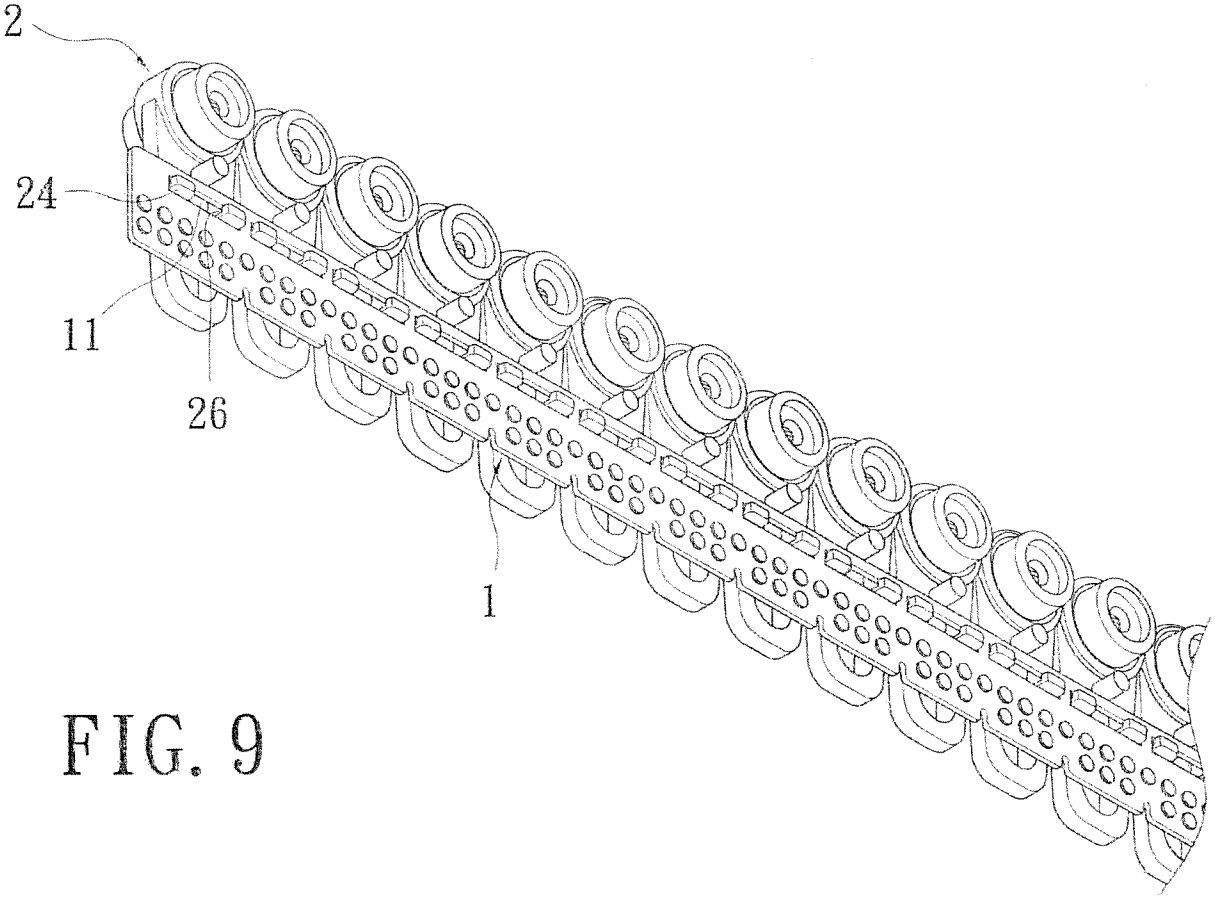
FIG. 9 is a perspective view to show the fifth embodiment of the combination of the rack and the sliding members of the present invention.
Figure 10:
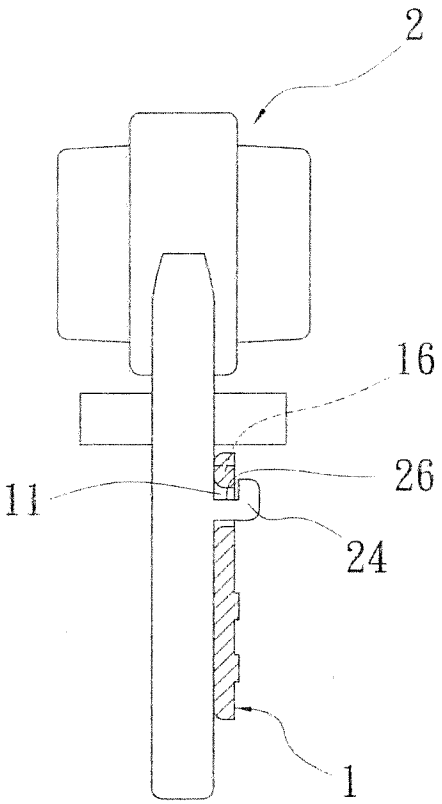
FIG. 10 is an end cross sectional view of the fifth embodiment of the combination of the rack and the sliding members of the present invention.

As shown in FIGS. 8 to 10, this embodiment is similar to the embodiment in FIG. 1, wherein each top inside 111 has multiple positioning members 16 extending therefrom which are located correspondingly to the engaging portions 24 of the sliding member 2. The structure of the sliding members 2 is similar to that of FIG. 7, the difference is that the engaging portions 24 of the sliding member 2 do not have the bosses 25, instead, the engaging portions 24 each have a positioning recess 26 with which the positioning members 16 of the rack 1 are engaged.

Figure 11:
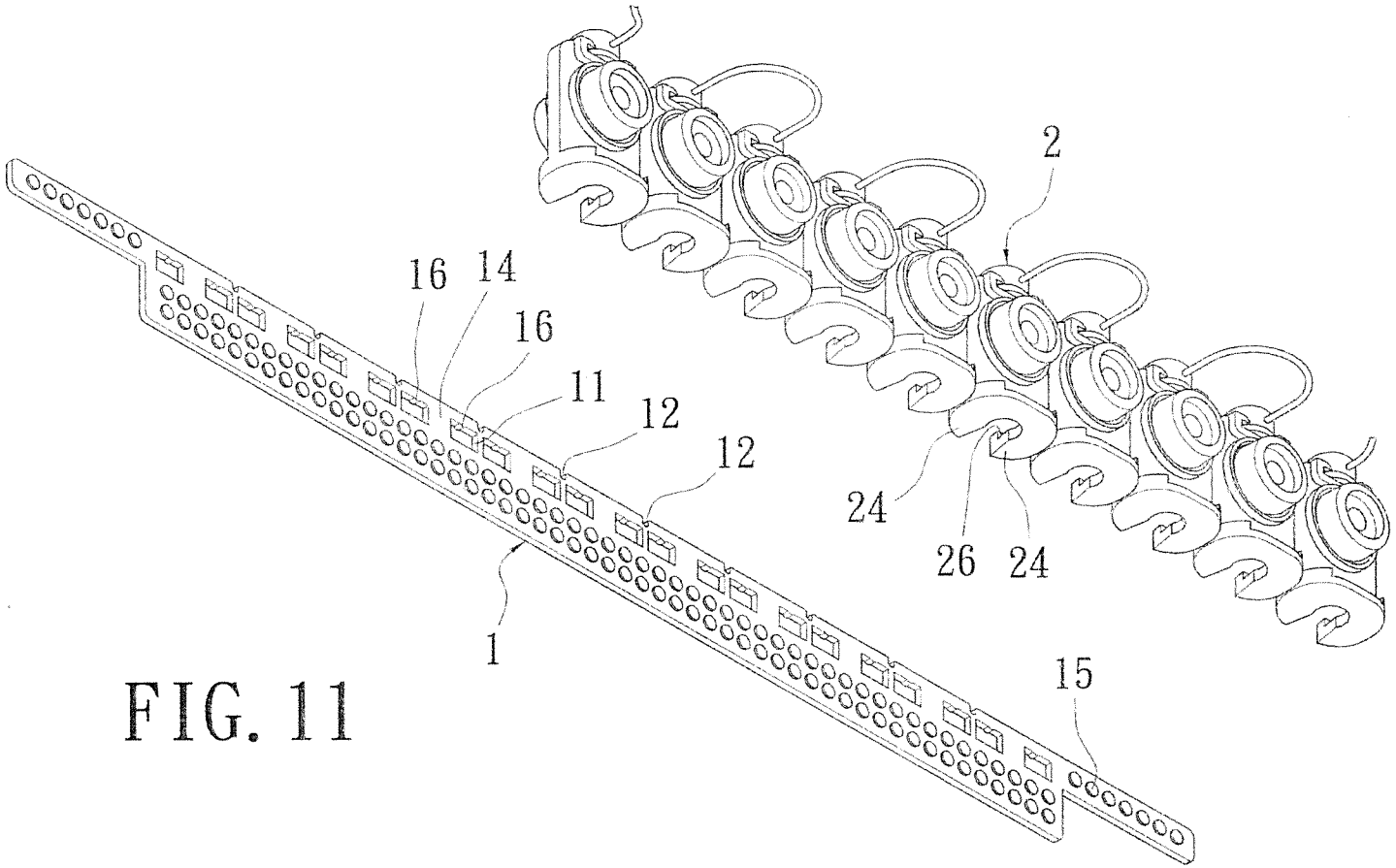
FIG. 11 is an exploded view to show the sixth embodiment of the rack and the sliding members of the present invention.
Figure 12:
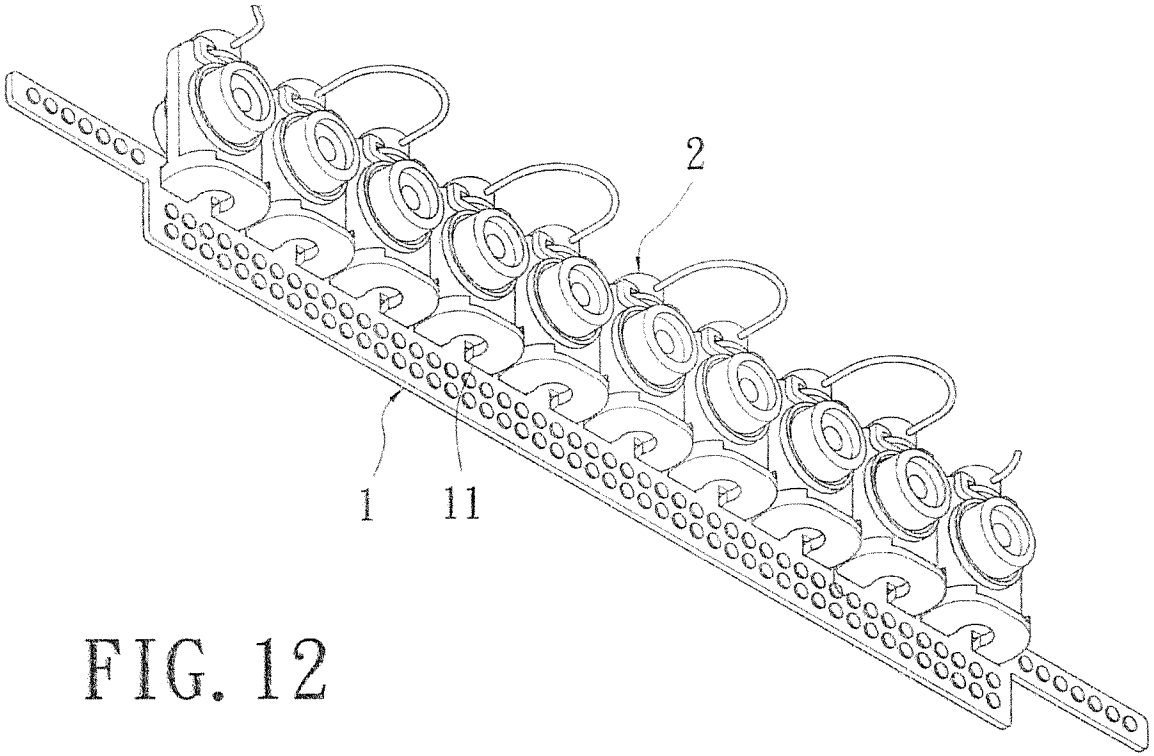
FIG. 12 is a perspective view to show the sixth embodiment of the combination of the rack and the sliding members of the present invention.
Figure 13:
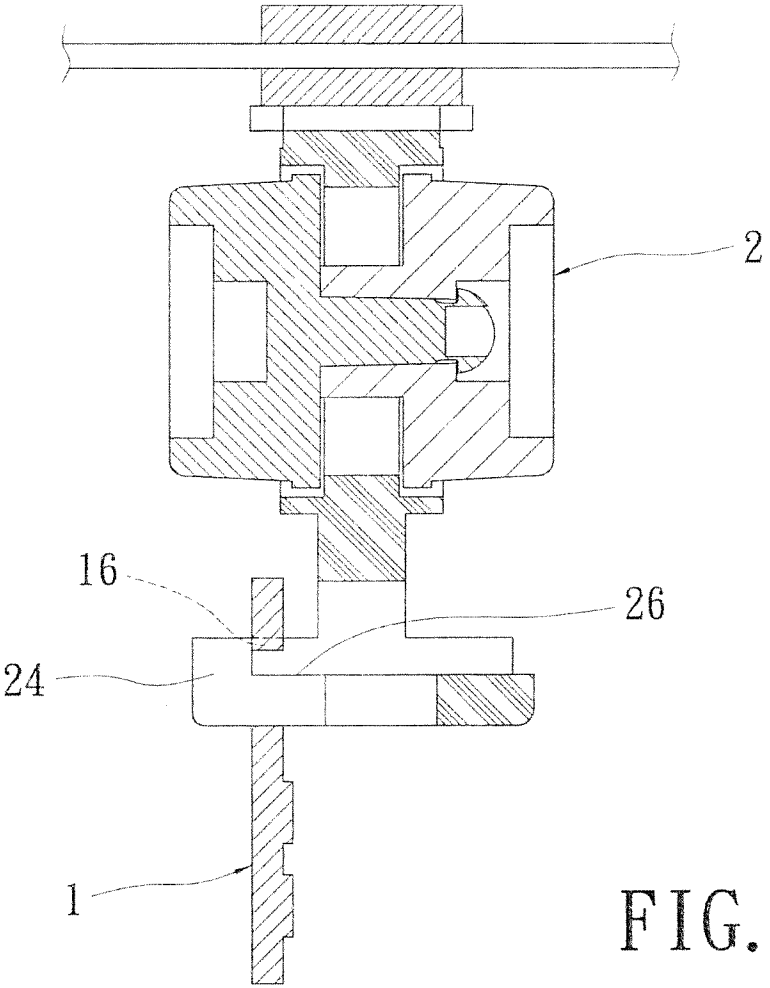
FIG. 13 is an end cross sectional view of the sixth embodiment of the combination of the rack and the sliding members of the present invention.

As shown in FIGS. 11 to 13, the rack 1 of this embodiment is similar to that disclosed in FIG. 6, wherein each top inside 111 has multiple positioning members 16 extending therefrom, and the notches 12 are located at the top edge of the rack 1. The structure of the sliding members 2 is similar to that of FIGS. 2-4, the difference is that the engaging portions 24 of the sliding member 2 do not have the bosses 25, instead, the engaging portions 24 each have a positioning recess 26 with which the positioning members 16 of the rack I are engaged.

While we have shown and described the embodiment in accordance with the present invention, it should be clear to those skilled in the art that further embodiments may be made without departing from the scope of the present invention.

What is claimed is:

1. An installation unit of a window curtain assembly, comprising:

a rack being an elongate plate having multiple slots defined therethrough, and multiple sliding members each having a connection portion which is adapted to be connected to the curtain, a roller connected to each sliding member and adapted to move along a rail of the window curtain assembly, multiple engaging portions extending horizontally along an axis of the roller from one of two sides of each of the sliding members, a boss extending from each of the engaging portions, the engaging portions engaged with the slots of the rack and the bosses are stopped by an outside of the slots.

2. The installation unit as claimed in claim 1, wherein the slots are separated by connection sections and each connection section is connected between the top and bottom insides of the adjacent slots.

3. The installation unit as claimed in claim 1, wherein the rack has multiple notches defined in one of two sides thereof and the notches are located alternatively to the slots.

4. The installation unit as claimed in claim 1, wherein the elongated plate has anti-slip protrusions formed on at least one surface thereof.

5. The installation unit as claimed in claim 1, wherein the elongated plate has a pulling section extending from one of two ends thereof.

6. The installation unit as claimed in claim 1, wherein the each sliding member is connected with a cord and the sliding members are evenly separated to each other on the cord.

7. An installation unit of a window curtain assembly, comprising:

a rack being an elongated plate having multiple slots defined therethrough, each of the slots having a top inside and a bottom inside, each top inside having multiple positioning members extending therefrom, and multiple sliding members each having a connection portion which is adapted to be connected to the curtain, a roller connected to each sliding member and adapted to move along a rail of the window curtain assembly, multiple engaging portions extending horizontally along an axis of the roller from one of two sides of each of the sliding members, each engaging portion having a positioning recess defined therein, the engaging portions engaged with the slots of the rack and the positioning members engaged with the positioning recesses.

8. The installation unit as claimed in claim 7, wherein the rack has multiple notches defined in one of two sides thereof and the notches are located alternatively to the slots.

9. The installation unit as claimed in claim 7, wherein the elongated plate has anti-slip protrusions formed on at least one surface thereof.

10. The installation unit as claimed in claim 7, wherein the elongated plate has a pulling section extending from one of two ends thereof.

11. The installation unit as claimed in claim 7, wherein the slots are separated by connection sections and each connection section is connected between the top and bottom insides of the adjacent slots.

12. The installation unit as claimed in claim 7, wherein the each sliding member is connected with a cord and the sliding members are evenly separated to each other on this cord.

* * * * *